United States Patent [19]

Dawson

[11] Patent Number: 4,729,143

[45] Date of Patent: Mar. 8, 1988

[54] PAINT PAD REFILL DEVICE

[76] Inventor: Vernon C. Dawson, 16 Marvin Ave., Brewster, N.Y. 10509

[21] Appl. No.: 909,563

[22] Filed: Sep. 22, 1986

[51] Int. Cl.[4] ..... A47L 13/00; A47K 7/02

[52] U.S. Cl. ..... 15/210 R; 15/146; 15/244.1; 206/229

[58] Field of Search ..... 15/209 R, 228, 244 R, 15/143 R, 145, 210 R, 146; 206/229

[56] References Cited

U.S. PATENT DOCUMENTS

| | | | |
|---|---|---|---|
| 1,778,270 | 10/1930 | Miller | 15/244 C |
| 2,767,650 | 10/1956 | Yunker et al. | 15/210 R X |
| 3,484,795 | 12/1969 | Nicolay | 15/210 R X |
| 3,717,896 | 2/1973 | Chase et al. | 15/210 R |
| 4,127,911 | 12/1978 | Cupp et al. | 15/210 R |
| 4,219,899 | 9/1980 | Zurawin et al. | 15/210 R |

*Primary Examiner*—Peter Feldman
*Attorney, Agent, or Firm*—CTC & Associates

[57] ABSTRACT

A paint pad refill device comprises a backing plate of length changeable to a final length appropriate for fitting a particular paint pad holder of any a plurality of standard lengths, means for attaching the plate to the particular holder after the length of the plate is changed to its final length, and a foam pad associated with the plate and of length changeable to substantially the final length of the plate.

10 Claims, 7 Drawing Figures

PAINT PAD REFILL DEVICE

BACKGROUND OF THE INVENTION

This invention relates to paint pad refill devices and more particularly to a paint pad refill device of universal application to paint pad holders of various sizes.

Paint pad holders come in a plurality of sizes, depending on the manufacturer, there being no standard size. Paint pad refills supplied by each manufacturer typically fit only that manufacturer's paint pad holders. Thus, a retail outlet that carries paint pad holders of one manufacturer can not supply pad refills to a customer who owns a paint pad holder of another manufacturer, with the result that the customer must go elsewhere for a paint pad refill. Possibly, he will go elsewhere for his other painting requirements, such as paint, terpentine and drop cloths, as well.

The present invention has for its main object the provision of a universal paint pad refill device that overcomes the disadvantages outlined in the preceding paragraph and promotes the convenience of one-stop shopping for painting needs.

It is another object to provide such a universal paint pad refill device that is of extremely low cost, so low that retailers might even handle it as a giveaway item when the customer buys a minimum quantity of painting material.

A further object is to provide a paint pad refill device that can be sized by the user to fit any standard holder.

Other objects and advantages will appear hereinafter.

The reader may be interested in the following prior U.S. patents, located in a search hereon:

| U.S. Pat. No. | Date | Inventor |
|---|---|---|
| 3,289,236 | December 6, 1966 | Salka |
| 4,127,911 | December 5, 1978 | Cupp et al. |
| 4,155,140 | May 22, 1979 | Janssen et al. |
| 4,215,448 | August 5, 1980 | Burns et al. |
| 4,279,103 | July 21, 1981 | Rodarte |
| 4,349,933 | September 21, 1982 | Thompson |

Salka teaches a painter's edging tool of the replaceable element type.

Cupp et al. discloses a paint applicator having a multipositional handle.

Janssen et al. is another example of a paint applicator with a detatchable handle and a paint applying pad.

Burns et al. is yet a further example of a paint applicator having a handle and a replaceable pad, being directed to a simplified design for use in either of two paint applying modes and an improved mounting mechanism.

Rodarte discloses a hand tool for use in sanding louver boards, and Thompson teaches a push broom with a bottom surface provided with a fabric coating instead of bristles.

These prior patents seem irrelevant to the invention.

SUMMARY OF THE INVENTION

A paint pad refill device embodying the invention can very simply be applied by the user to any standard holder. The device comprises a backing plate of length changeable to a final length appropriate for fitting a particular paint pad holder of any of a plurality of standard lengths, means for attaching the plate to the particular holder after the length of the plate is changed to its final length holder, and a foam pad associated with the plate and of length changeable to substantially the final length of the plate.

DESCRIPTION OF THE INVENTION

Figure 2:
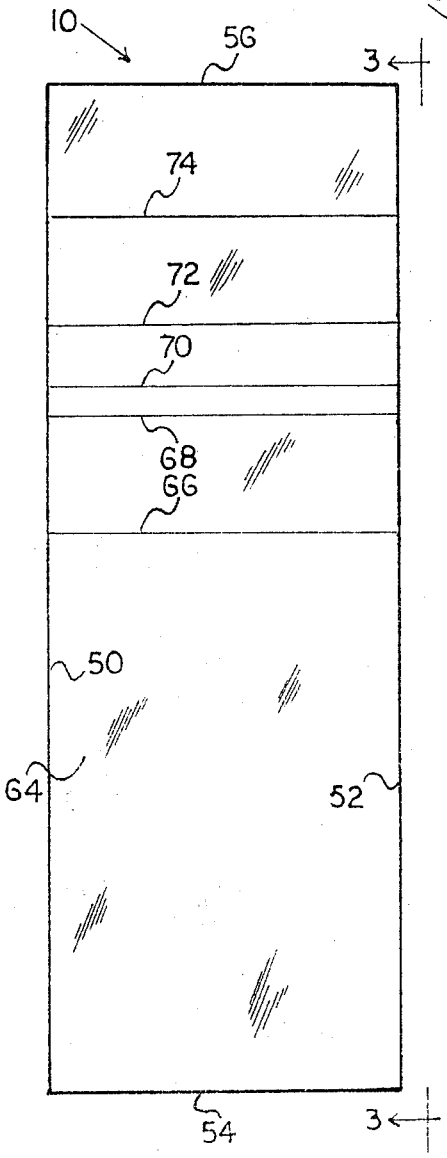
FIG. 2 is a plan view of one face of a preferred foam pad that is a second component of the inventive paint pad refill device.
Figure 3:
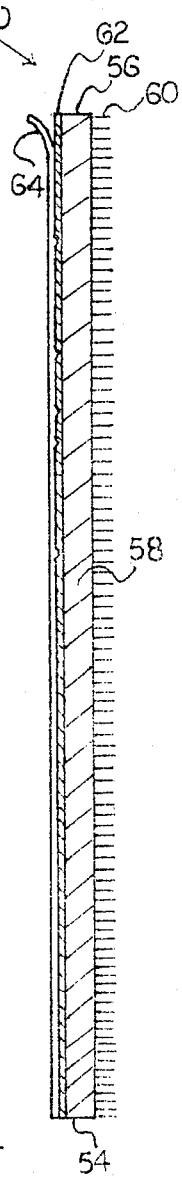
FIG. 3 is an edge view of the foam pad of FIG. 2, taken on line 3—3 of FIG. 2.

A paint pad refill device embodying the invention comprises a backing plate and a foam pad 10, the latter being shown in FIGS. 2 and 3. Foam pad 10 is useful with a plurality of different inventive backing plates, as will become apparent hereinafter.

Figure 1:
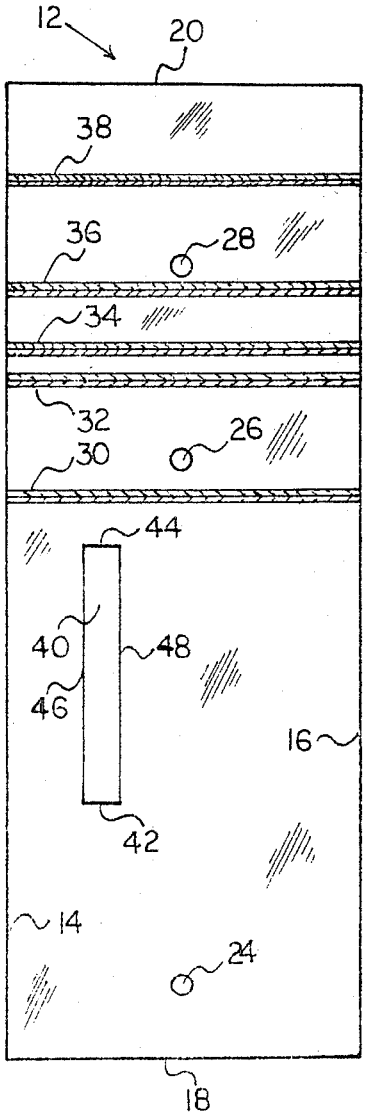
FIG. 1 is a plan view of one face of a preferred backing plate that is a first component of the inventive paint pad refill device.

One face of a first preferred backing plate 12 is shown in FIG. 1. Backing plate 12 is a rectangular piece of thin sheet material, such as galvanized steel or suitable plastic material, which would be cheaper and lighter than metal. Plate 12 has parallel side edges 14 and 16, parallel end edges 18 and 20 perpendicular to side edges 14 and 16, side edges 14 and 16 defining a longitudinal centerline 22 midway therebetween. The width of backing plate 12 from side edge 14 to side edge 16 is 3.5 inches (8.9 cm) and the length of backing plate 12 from end edge 18 to end edge 20 is about 9.5 inches (24.1 cm). Centerline 22 is 1.75 inches (4.4 cm) from each of side edges 14 and 16. Backing plate 12 has three 0.25 inch (0.64 cm) diameter holes 24, 26 and 28 therethrough, the centers of which are on centerline 22 and spaced from end edge 18 0.6875 inch (17.5 cm), 5.6875 inches (14.4 cm) and 7.6875 inches (19.5 cm), respectively. Backing plate 12, also has, on the face visible in FIG. 1, five score lines 30, 32, 34, 36 and 38, each extending from side edge 14 to side edge 16 and perpendicular thereto. Score lines 30, 32, 34, 36 ad 38 are spaced 5.5 inches (14.0 cm), 6.5625 inches (16.7 cm), 7.4375 inches (18.9 cm) and 8.5 inches (21.6 cm) from end edge 18, respectively.

Backing plate 12 further has a rectangular opening 40 therethrough, with end edges 42 and 44 spaced 2.5 inches (6.4 cm) and 5 inches (12.8 cm), respectively from end edge 18 and side edges 46 and 48 spaced 0.75 inch (1.9 cm) and 1.125 inches (2.9 cm), respectively, from side edge 14. Thus, opening 40 is 2.5 inches (6.4 cm) long and 0.375 inch (0.95 cm) wide. The effective length of backing plate 12 is readily changeable by the user by severing backing plate 12 along any of score lines 30, 32, 34, 36 and 38, as by an ordinary pair of scissors or a razor knife, or by a simple bending or snapping action.

Foam pad 10, illustrated in FIGS. 2 and 3, is rectangular in plan view, and has parallel side edges 50 and 52 and parallel end edges 54 and 56. The width of foam pad 10 from side edge 50 to side edge 52 is 3.5 inches (8.9 cm) and the length of foam pad 10 from end edge 54 to end edge 56 is 10 inches (25.4 cm). It is noted that foam pad 10 is slightly longer than backing plate 12. Foam pad is slightly longer than backing plate so as to extend beyond the plate to permit paint loaded pad to make corner contact and "cut in". Foam pad 10 is 0.625 inch (1.6 cm) thick and comprises a sponge-like foam body portion 58 having a thickness of 0.375 inch (0.95 cm). One face of body portion 58 is covered with painting bristles 60 protruding therefrom, and a tape 62 having adhesive material on both sides is adhered to and covers the other face of body portion 58. A sheet of paper 64 covers one face and is adhered to tape 62, the paper being strippable therefrom. Paper 64 has five sizing lines 66, 68, 70, 72 and 74 on its exposed face, each extending from side edge 50 to side edge 52, and perpendicular thereto. Lines 66, 68, 70, 72 and 74 are spaced 5.5 inches (14.0 cm), 6.5625 inches (16.7 cm), 6.875 inches (17.5 cm), 7.4375 inches (18.9 cm) and 8.5 inches (21.6 cm) from end edge 54, respectively. Foam pad 10 can be cut to size by severing the same along an appropriate one of sizing lines 66, 68, 70, 72 and 74, as by the scissors or razor knife.

It is apparent that score lines 30, 32, 34, 36 and 38 correspond in spacing from edge 18 to the spacing of sizing lines 66, 68, 70, 72 and 74, respectively, from edge 54.

Foam pad 10 and backing plate 12 may be supplied in a kit, which may also include appropriate attaching hardware (not shown), such as two wing nuts, two screws, two small washers and two large washers.

The use of foam pad 10 and backing plate 12 will now be described, it being assumed that the user has removed a used foam pad (not shown) from his or her holder (not shown). Backing plate 12 is placed adjacent to the holder and the user selects that score line 30, 32, 34 36 and 38 which most nearly corresponds to the length of the holder. The user then severs backing plate 12 along the selected score line, using a pair of scissors or a razor knife. The user then attaches the remaining portion of backing plate 12 to the holder, utilizing appropriate hardware, such as screws, wing nuts and washers and appropriate ones of holes 24, 26 and 28 and pre-existing apetures in the holder. The screws may be engaged by a regular screwdriver during tightening. Elongate opening 40 permits the universal backing plate to accomodate the variable positioned hold on screws as is found in the different brands of paint pads.

Foam pad 10 is then cut along the appropriate one of sizing lines 66, 68, 70, 72 and 74 to a length approximating the length of the installed backing plate 12, the sheet of paper 64 is then stripped from pad 10 to expose the adhesive on tape 62 and pad 10 is pressed against backing plate 12 with the so exposed adhesive on pad 10 engaging backing plate 12. The user is then ready to start painting.

Figure 5:
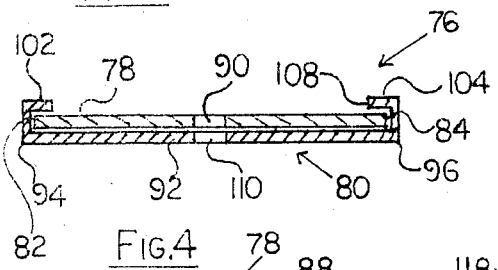
FIG. 5 is an end view of the of the backing member of FIG. 4, taken on line 5—5 of FIG. 4.
Figure 4:
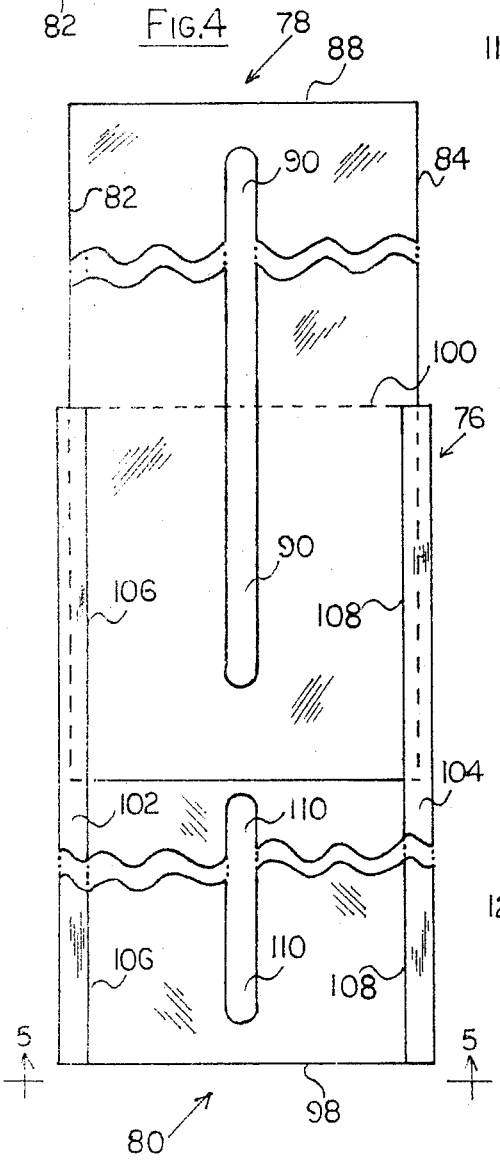
FIG. 4 is a fragmentary front plan view of a second preferred backing plate that is a component of the inventive paint pad refill device.

FIGS. 4 and 5 show a second preferred backing plate 76 that may be used as the first component of the inventive paint pad refill device, alternatively to backing plate 12. Foam pad 10 is usable with either backing plate 12 or backing plate 76.

Backing plate 76 includes an inner or strap member 78 and an outer or channel member 80. Inner member 78 has parallel side edges 82 and 84, parallel end edges 86 and 88 and a hole 90 therethrough, elongated along the longitudinal centerline of member 78. Outer member 80 has rectangular bottom portion 92 having parallel side edges 94 and 96 and parallel end edges 98 and 100. Outer member 80 further has upper flange portions 102 and 104 parallel to bottom portion 92 and spaced therefrom a distance slightly greater than the thickness of inner member 78. Flange portions 102 and 104 are integrally joined to bottom portion 92 more particularly to side edges 94 and 96, respectively, and have parallel confronting inner edges 106 and 108, respectively. Inner edges 106 and 108 are spaced from each other a distance that is less than the width of inner member 78 between side edges 82 and 84 but greater than the width of foam pad 10 between side edges 50 and 52. Finally, outer member 80 has a hole 110 through bottom portion 92, elongated along the longitudinal centerline of bottom portion 92. Members 78 and 80 are telescopically interfittable and are shown in telescopically interfitting relationship with each other.

Thus, the length of backing plate 76, between end edges 88 and 98 (or between end edges 86 and 100) can be brought to the length appropriate for a particular holder by adjusting the relative position of inner member 78 with respect to outer member 80. Backing plate 76 is then attached to the holder by appropriate screws (not shown) inserted in holes 90 and 110 and corresponding holes in the holder and by securing the same with wing nuts (not shown). Foam pad 10 is then cut to proper length, the sheet of paper 64 is stripped from pad 10 to expose the adhesive on tape 62 and pad 10 is pressed against inner member 78 and outer member 80, more particularly, bottom portions 92 thereof, between confronting edges 106 and 108. The user is then ready to start painting.

Figure 6:
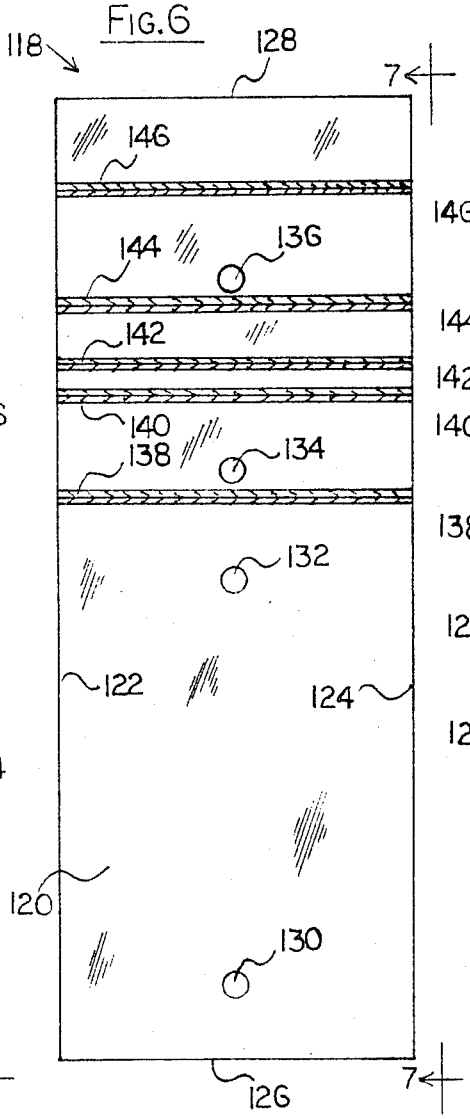
FIG. 6 is a plan view of a paint pad refill device that is an additional preferred embodiment of the invention.
Figure 7:
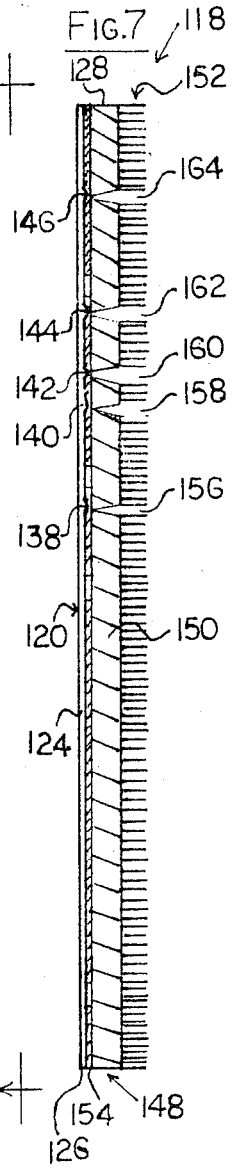
FIG. 7 is a view on line 7—7 of FIG. 6.

FIGS. 6 and 7 show a paint pad refill device, generally indicated at 118, that is an additional preferred embodiment of the invention. Device 118 comprises a backing plate 120 that is, like plate 20, a rectangular piece of thin sheet material, and may be dimensioned the same as plate 20, having side edges 122 and 124 and end edges 126 and 128, with four holes 130, 132, 134 and 136 therethrough, the centers of which are on the longitudinal centerline of plate 120, and five grooved score lines 138, 140, 142, 144 and 146 on one face of plate 120, each score line extending from side edge 122 to side edge 124 and perpendicular thereto.

Device 118 further comprises a rectangular foam pad 148 (FIG. 7) of substantially the same dimensions as plate 120. Pad 148 is similar to pad 10, having a sponge-like foam body portion 150 one face of which is covered with painting bristles 152 protruding therefrom.

A tape 154 having adhesive material on both sides is adhered to and covers the other face of body portion 150 and is also adhered to the face of plate 120 that does not contain score lines 138, 140, 142, 144 and 146, thus to form an assembly of plate 120 and pad 148.

Body portion 150 of pad 148 is preferably provided with five cuts 156, 158, 160, 162 and 164, each extending at least part way therethrough and aligned with score lines 138, 140, 142, 144 and 146, respectively, in one-to-one registry therewith.

To use device 118, the user merely selects the appropriate score line 138, 140, 142, 144 and 146 on which severing is desired, snaps plate 120 apart at the selected score line and completes the separation of pad 148 at the location of the cut 156, 158, 160, 162 or 164 that is in registry with the severed score line. Device 118 is placed against the holder and secured thereto by attaching means, that in this instance may be self-tapping screws (not shown) insertable through holes in the holder and turnable into engagement with appropriate remaining ones of plate holes 130, 132, 134 and 136. The user is now ready to start painting.

The invention well attains the stated objects and advantages and others.

The disclosed details are exemplary only and are not to be taken as limitations on the invention except as those details may be included in the appended claims.

What is claimed is:

1. A paint pad refill device comprising a backing plate of length changeable to a final length appropriate for fitting a particular paint pad holder of any of a plurality of standard lengths, means for attaching said plate to said particular holder, after the length of said plate is changed to said final length, and a foam pad associated with said plate and of length changeable to substantially said final length of said plate, wherein said foam pad includes a sponge-like foam body portion, painting bristles protruding from one face of said body portion, a tape having adhesive material on both sides covering and adhered to the other face of said body portion, and said device further comprises a sheet of paper covering and adhered to said tape but strippable therefrom, said sheet of paper having an exposed face, and sizing lines on said exposed face, whereby said pad can be severed to said final length along an appropriate one of said sizing lines, after attachment of said plate to said holder, and said pad is thereupon adherable to said plate by stripping said sheet of paper from said pad to expose the adhesive material on said tape and pressing said pad against said plate to bring the exposed adhesive material into engagement with said plate.

2. A device according to claim 1 wherein said plate has holes therethrough and said attaching means includes screws insertable through said holes and corresponding holes in the particular said holder and wing nuts for engaging said screws.

3. A device according to claim 1 wherein said backing plate is generally rectangular and said pad is generally rectangular, and said sizing lines are parallel to each other and perpendicular to side edges of said pad.

4. A device according to claim 1 wherein said backing plate comprises a rectangular piece of material having a plurality of parallel score lines perpendicular to and extending from one side edge to the opposite side edge of said piece of material, said score lines spaced at predetermined distances from an end edge of said piece of material, said backing plate being severable along an appropriate one of said score lines to change the length of said backing plate to said final length.

5. A device according to claim 1 wherein said backing plate comprises telescopically interfittable inner and outer members, said inner member being a rectangular strap member and said outer member being a channel member, said strap member having parallel side edges, parallel end edges and a hole therethrough, elongated along the longitudinal centerline of said strap member, said channel member including a rectangular bottom portion having parallel side edges and parallel end edges and upper flange portions parallel to said bottom portion and spaced therefrom a distance slightly greater than the thickness of said inner member and integrally joined to said bottom portion, said flange portions having parallel confronting inner edges spaced from each other a distance less than the width of said inner member but greater than the width of said foam pad, said bottom portion having a hole therethrough, elongated along the longitudinal centerline of said bottom portion, said inner and outer members being adjustable longitudinally of each other to the length of the particular said holder and then attached thereto by said attaching means, utilizing said elongated holes.

6. A device according to claim 2 wherein said backing plate, said foam pad, said screws and said nuts are packaged in a kit.

7. A paint pad refill device comprising a backing plate of length changeable to a final length appropriate for fitting a particular paint pad holder of any of a plurality of standard lengths, means for attaching said plate to said particular holder, after the length of said plate is changed to said final length, and a foam pad associated with said plate and of length changeable to substantially said final length of said plate, wherein said foam pad includes a rectangular sponge-like body portion, painting bristles protruding from one face of said body portion, the other face of said body portion being adhered to said plate to form an assembly of said plate and said pad, and said backing plate comprises a rectangular piece of material having a plurality of parallel score lines perpendicular to and extending from one side edge to the opposite side edge of said piece of material, said score lines spaced at predetermined distances from an end edge of said piece of material, and said backing plate being severable along an appropriate one of said score lines to change the length of said backing plate to said final length.

8. A device according to claim 7 wherein said body portion of said pad is provided with a plurality of cuts each extending at least part way therethrough and in one-to-one registry with said score lines, so that when said backing plate is severed along said appropriate score line, said pad will be readily separated along said cut that is in registry with said appropriate score line.

9. A device according to claim 7 wherein said plate has holes and said attaching means includes self-tapping screws insertable through holes in the particular holder and turnable into self-tapping engagement with remaining ones of said holes in said plate.

10. A device according to claim 9 wherein said assembly of said plate and said pad and said self-tapping screws are packaged in a kit.

* * * * *